US008235737B2

(12) United States Patent
Cheng et al.

(10) Patent No.: US 8,235,737 B2
(45) Date of Patent: Aug. 7, 2012

(54) LIGHT STRING SYSTEM

(75) Inventors: Chung Wai (Paul) Cheng, Hong Kong (CN); Yong Fu, Zhu Yang Town (CN); Chi Yin (Alan) Leung, Hong Kong (CN); Hou-You Han, Guang Shui (CN)

(73) Assignee: Polygroup Macau Limited (BVI) (VG)

( * ) Notice: Subject to any disclaimer, the term of this patent is extended or adjusted under 35 U.S.C. 154(b) by 130 days.

(21) Appl. No.: 12/959,448

(22) Filed: Dec. 3, 2010

(65) Prior Publication Data

US 2011/0136361 A1 Jun. 9, 2011

Related U.S. Application Data

(60) Provisional application No. 61/285,068, filed on Dec. 9, 2009.

(51) Int. Cl.
*H01R 29/00* (2006.01)

(52) U.S. Cl. ..... 439/188

(58) Field of Classification Search ..... 439/188, 439/699.2; 200/51.1; 362/288, 255, 285, 362/249.12, 651–652, 659
See application file for complete search history.

(56) References Cited

U.S. PATENT DOCUMENTS 5,071,362 A 12/1991 Martens et al.
5,139,343 A 8/1992 Lin
5,453,664 A * 9/1995 Harris ..... 315/185 S
5,700,082 A 12/1997 Peng
5,707,138 A 1/1998 Pan
5,722,766 A 3/1998 Shu
5,752,765 A 5/1998 Liou
5,899,764 A 5/1999 Harting et al.
5,964,520 A 10/1999 Lee
5,969,469 A 10/1999 Wang
6,048,074 A 4/2000 Wang
6,048,076 A 4/2000 Lin
6,074,073 A 6/2000 Huang
6,123,433 A 9/2000 Chen
6,203,169 B1 3/2001 Coushaine et al.
6,250,782 B1 6/2001 Huang
6,257,740 B1 * 7/2001 Gibboney, Jr. ..... 362/288
6,382,810 B1 5/2002 Tseng
6,382,813 B1 5/2002 Huang
6,454,436 B1 9/2002 Ilyes et al.
6,461,027 B1 10/2002 Yagi et al.
6,469,428 B1 10/2002 Thiel et al.
6,533,437 B1 3/2003 Ahroni
6,533,457 B1 3/2003 Schwenke et al.
6,609,814 B2 8/2003 Ahroni
6,755,552 B2 6/2004 Lee
6,805,463 B2 10/2004 Shieh
(Continued)

*Primary Examiner* — Jean F Duverne
(74) *Attorney, Agent, or Firm* — Ryan A. Schneider, Esq.; Troutman Sanders LLP

(57) ABSTRACT

A lamp system used in a light string system comprises a light assembly and a socket assembly. The light assembly comprises a light source, a base in communication with the light source, and a bypass activating system. The socket assembly comprises a socket adapted to receive the light assembly and a bypass mechanism having a first position and a second position. The bypass mechanism is in the first position when the light assembly is not seated in the socket assembly. When the bypass mechanism in the first position, current flows across the bypass mechanism. When the light assembly is inserted into the socket assembly, the bypass activating system of the light assembly moves the bypass mechanism into the second position, and current flows through the light source instead of the bypass mechanism.

18 Claims, 19 Drawing Sheets

U.S. PATENT DOCUMENTS

| | | | |
|---|---|---|---|
| 6,932,493 | B2 | 8/2005 | Giannopoulos et al. |
| 6,974,354 | B2 | 12/2005 | Wu |
| 7,153,019 | B2 | 12/2006 | Kuo |
| 7,186,017 | B2 | 3/2007 | Kuo |
| 7,253,556 | B1 | 8/2007 | Gibboney et al. |
| 7,261,458 | B2 | 8/2007 | Janning |
| 7,264,392 | B2 | 9/2007 | Massabki et al. |
| 7,399,109 | B2 | 7/2008 | Cheng |
| 7,399,110 | B2 | 7/2008 | Cheng |
| 7,484,995 | B2 | 2/2009 | Ding |
| 7,554,266 | B1 | 6/2009 | Chen |
| 7,557,497 | B1 | 7/2009 | Gibboney et al. |
| 7,575,362 | B1 | 8/2009 | Hsu |
| 7,581,870 | B2 | 9/2009 | Massabki et al. |
| 7,591,685 | B2 | 9/2009 | Zhu et al. |
| 7,626,131 | B1 | 12/2009 | Gibboney, Jr. |
| 7,626,321 | B1 | 12/2009 | Gibboney, Jr. |
| 7,629,544 | B1 | 12/2009 | Gibboney, Jr. |
| 7,633,024 | B1 | 12/2009 | Gibboney, Jr. |
| 2004/0264183 | A1 | 12/2004 | Pan |
| 2005/0030743 | A1 | 2/2005 | Nagano et al. |
| 2005/0286267 | A1 | 12/2005 | Wang |
| 2006/0109678 | A1 | 5/2006 | Chuang |
| 2007/0064449 | A1 | 3/2007 | Bornemeier et al. |
| 2008/0024071 | A1 | 1/2008 | Yu |
| 2008/0025024 | A1 | 1/2008 | Yu |
| 2008/0130284 | A1 | 6/2008 | Altamura et al. |
| 2008/0186740 | A1 | 8/2008 | Huang et al. |
| 2008/0211415 | A1 | 9/2008 | Altamura |
| 2008/0258630 | A1 | 10/2008 | Collins et al. |
| 2008/0258860 | A1 | 10/2008 | Collins et al. |
| 2008/0310163 | A1 | 12/2008 | Li |
| 2009/0213620 | A1 | 8/2009 | Lee |
| 2009/0279325 | A1 | 11/2009 | Massabki et al. |
| 2009/0296396 | A1 | 12/2009 | Gibboney, Jr. |
| 2009/0296397 | A1 | 12/2009 | Gibboney, Jr. |
| 2009/0296424 | A1 | 12/2009 | Gibboney, Jr. |
| 2009/0302737 | A1 | 12/2009 | Gibboney, Jr. |

* cited by examiner

LIGHT STRING SYSTEM

CROSS REFERENCE TO RELATED APPLICATION

This application claims benefit, under 35 U.S.C. §119(e), of U.S. Provisional Application Ser. No. 61/285,068, filed 9 Dec. 2009, the entire contents and substance of which are hereby incorporated by reference.

BACKGROUND OF THE INVENTION

1. Field of the Invention

Embodiments of the present invention relate to a lamp system used in a light string system and, more particularly, to a socket assembly adapted to receive a light assembly, wherein the lamp system is designed such that a remainder of the lights in the light string system remain lit even when one or more individual light assemblies are broken, missing, or not properly seated from associated socket assemblies.

2. Description of the Related Art

Light strings are known in the art. For instance, light strings are predominantly used during the holiday season for decorative purposes, e.g., Christmas tree lights, outdoor holiday lights, and icicles light sets.

Conventional light strings are typically arranged with lights on the strings being electrically connected in series, rather than in a parallel arrangement. Unfortunately, there are disadvantages to designing a light string in series. When a single light bulb is removed from, broken, or improperly seated in a socket, the remaining lights in the series are rendered inoperable. Because each light bulb within its respective socket completes the electrical circuit, when a light bulb is removed, breaks, or is improperly seated in the socket, a gap is created in the circuit, i.e., an open circuit is formed. Therefore, electricity is unable to continue to flow through the circuit. When a "good" or operable light bulb is properly inserted into and thus sits in the socket, the light bulb completes the circuit and allows electricity to flow uninterrupted through the light string.

BRIEF SUMMARY OF THE INVENTION

Embodiments of the present invention relate to a lamp system for use in a light string system. The lamp system comprises a light assembly and a socket assembly. The light assembly comprises a light source, a base in communication with the light source, and a bypass activating system. The socket assembly comprises a socket adapted to receive the light assembly, first and second socket terminals, and a bypass mechanism having a first position and a second position.

When the bypass mechanism is in the first position, current flows from the first socket terminal, through the bypass mechanism, and to the second socket terminal. When the light assembly is inserted into the socket assembly, the bypass mechanism moves into its second position. In the second position, current does not flow through the bypass mechanism, but flows through the lamp system by passing through the light source of the light assembly.

The bypass activating system of the light assembly is adapted to move the bypass mechanism of the socket assembly between the first and second positions.

In an exemplary embodiment, the socket is outfitted with grooves or cutouts along opposing sides. Other opposing sides, e.g., normal to the sides with grooves or cutouts, include the socket terminals. The bypass mechanism housed in the socket comprises a conductive element, a portion of which can be received by the grooves or cutouts of the sides of the socket. The conductive element is in a relaxed state when the light assembly is absent from the socket. In this relaxed state, the conductive element has arms that flex in opposite directions, each of which is in contact with a respective socket terminal. Upon inserting the light assembly into the socket, the bypass activating system, e.g., one or more downwardly extending members, extends from the base contacts a portion of one or both arms of the conductive element. The downwardly extending members can move the arms of the conductive element of the bypass mechanism away from the socket terminals, e.g., inwardly towards the center of the socket. The shape of a pair of downwardly extending members can collectively make, for example and not limitation, an upside-down V-shape. A space between the two downwardly extending members (i.e., the V-shape) receives and contacts the shunt assembly to disable the shunt. As a result, this opens the shunt assembly and permits energy to flow through the light assembly.

In an exemplary embodiment, the bypass mechanism comprises a holder and a conductive element. The conductive element of the bypass mechanism can be carried by the holder. In some embodiments, the holder is symmetrical along at least its length. The holder includes a cutout, which receives the conductive element near its midpoint. The conductive element of the bypass mechanism includes opposing arms that are bent at end, forming generally a "V" shape. When the light assembly is absent from the socket, the arms contact the opposing socket terminals of the socket to shunt the lamp system. When the light assembly is inserted into the socket, at least one downwardly extending member of the bypass activating system contacts one arm of the conductive element of the bypass mechanism to open the shunt and permit energy to flow through the light assembly.

These and other objects, features, and advantages of the present invention will become more apparent upon reading the following specification in conjunction with the accompanying drawings.

BRIEF DESCRIPTION OF THE DRAWINGS

The various embodiments of the invention can be better understood with reference to the following drawings. The components in the drawings are not necessarily to scale, emphasis instead being placed upon clearly illustrating the principles of the various embodiments of the present invention. In the drawings, like reference numerals designate corresponding parts throughout the several views.

DETAILED DESCRIPTION OF PREFERRED EMBODIMENTS

Figure 1:
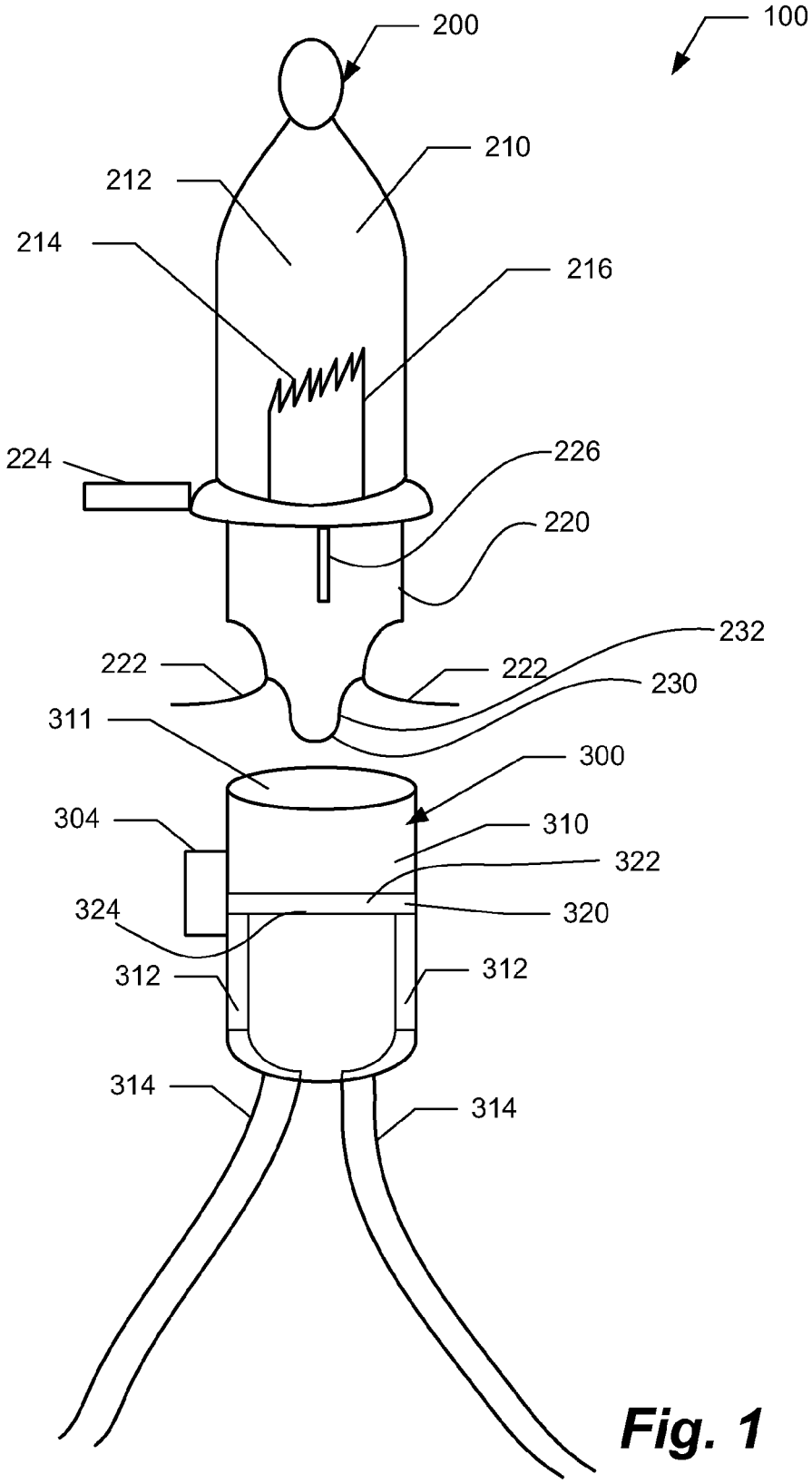
FIG. 1 is a side, partial cross-sectional view of a lamp system, in accordance with an exemplary embodiment of the present invention.

Although preferred embodiments of the invention are explained in detail, it is to be understood that other embodiments are contemplated. Accordingly, it is not intended that the invention is limited in its scope to the details of construction and arrangement of components set forth in the following description or illustrated in the drawings. The invention is capable of other embodiments and of being practiced or carried out in various ways. Also, in describing the preferred embodiments, specific terminology will be resorted to for the sake of clarity.

The components described hereinafter as making up various elements of the invention are intended to be illustrative and not restrictive. Many suitable components that would perform the same or similar functions as the components described herein are intended to be embraced within the scope of the invention. Such other components not described herein can include, but are not limited to, for example, similar components that are developed after development of the invention.

It must also be noted that, as used in the specification and the appended claims, the singular forms "a," "an" and "the" include plural referents unless the context clearly dictates otherwise.

Also, in describing the preferred embodiments, terminology will be resorted to for the sake of clarity. It is intended that each term contemplates its broadest meaning as understood by those skilled in the art and includes all technical equivalents which operate in a similar manner to accomplish a similar purpose.

Ranges may be expressed herein as from "about" or "approximately" one particular value and/or to "about" or "approximately" another particular value. When such a range is expressed, another embodiment includes from the one particular value and/or to the other particular value.

By "comprising" or "containing" or "including" is meant that at least the named compound, element, particle, or method step is present in the composition or article or method, but does not exclude the presence of other compounds, materials, particles, method steps, even if the other such compounds, material, particles, method steps have the same function as what is named.

It is also to be understood that the mention of one or more method steps does not preclude the presence of additional method steps or intervening method steps between those steps expressly identified. Similarly, it is also to be understood that the mention of one or more components in a device or system does not preclude the presence of additional components or intervening components between those components expressly identified.

In particular, embodiments of the invention are described in the context of being a lamp system of a light string system, where the lamp system incorporates a bypass or shunt. Embodiments of the invention, however, are not limited to use as a lamp system having a bypass. Rather, embodiments of the invention can be used as a circuit or other system with a mechanical shunt device is needed or desired. For example, although embodiments of the present invention are described as controlling flow through a light assembly when seated/unseated from a socket assembly, it will be understood that the disclosed socket assembly can be used with other insertable assemblies to shunt flow through the insertable assembly.

FIG. 1 is a partial cross-sectional view of a lamp system for use in a light string system. A typical light string system comprises a plurality of lamp systems 100 connected in series, wherein each lamp system 100 has a light assembly 200 and a socket assembly 300. The light assembly 200 can comprise a light source 210, a base 220 in communication with the light source 210, and a bypass activating system 230. The socket assembly 300 can comprise a socket 310 adapted to receive the light assembly 200 and a bypass mechanism 320 having a first position and a second position.

The light assembly 200 includes the light source 210, which provides light when energized. The light source 210 can be many types of light sources, including a light bulb, light emitting diode (LED), incandescent lamp, halogen lamp, fluorescent lamp, or the like. For example, the light source 210 can be a light bulb, as shown in FIG. 1. The light assembly 200 and, more typically, the light bulb 210 of the light assembly 200 has a shunt device (not shown) to keep the light string system illuminated, even if the bulb 210 burns out.

In an exemplary embodiment, for example when the light source 210 is a filamented light bulb, the light source 210 can include a globe 212 and a filament 214. The globe 212 is in communication with, and terminates at, the base 220. The globe 212 can be made of conventional translucent or transparent material such as plastic, glass, and the like. The globe 212 includes a hollow interior enabling protection of the filament 214.

When charged with energy, the filament 214 can illuminate the light source 210. A pair of conductors 216 can be in electrical communication with the filament 214. The conductors 216 enable energy into the light source 210 to illuminate the filament 214 and, as a result, the light source 210. The conductors 216 extend down through the base 220, wherein the conductors 216 can be integral with and/or in communication with a pair of lead wires 222 external the base 220. The lead wires 222 can be a pair of wires extending through a bottom of the base 220. A portion of the lead wires 222 that extends through the base can wrap around the base 220, for example, further extending upwardly in the direction of globe 212 adjacent the base 220.

The light assembly 200 further includes the base 220, which can be integrally formed with the light source 210 or a separate element from the light source 210. The base 220 communicates between the light source 210 and an associated socket 310, complimenting and facilitating the seating of the light assembly 200 into the socket 310. The base 220 can incorporate a least one ridge 226 to ensure a snug fit with the socket 310, preventing accidental disengagement of the light assembly 200 from the socket assembly 300 or ensuring proper seating of the light assembly 200 in the socket assembly 300. Other mechanical means can be used with the base 220 and the socket assembly 300 to ensure a tight fit.

For example, the light assembly 200 can also include a locking assembly to secure the light assembly 200 to the socket assembly 300. The locking assembly can be exterior or designed within the socket assembly 300 to fasten the connection of the light assembly 200 to the socket assembly 300 internally. The locking assembly can be external and can include cooperating light assembly elements 224 and socket assembly element 304. These elements 224 and 304 can be formed as a clasp and a lock to insert the clasp. For example, the base 220 of the light assembly 200 can include the element 224 that extends normal to the base 220 and can define an aperture. On the other end of the locking assembly can be the element 304 of the socket 310 to be inserted into the element 224 of the base 220. As the element 304 of the socket 310 is inserted into the element 224 of the base 220, the locking assembly locks the light assembly 200 to the socket assembly 300. Stringent Underwriters Laboratories (UL) requirements may require that lights and sockets fit tightly together, which may decrease the value of a locking mechanism in the lamp system 100. The improvement in injection molding machines now enables the production of sockets and lamp assemblies that have a tight, snug fit.

The bypass activating system 230 of the light assembly 200 can activate and deactivate the bypass mechanism 320 of the socket assembly 300 by moving the bypass mechanism 320 between the first and second positions. The bypass activating system 230 can extend in a downward direction from base 220 of the light assembly 200 to activate the bypass mechanism 320 of the socket assembly 300 upon the proper seating of the light assembly 200 in the socket assembly 300. The bypass activating system 230 can include one or more downwardly extending members. In one embodiment, the bypass activating system 230 can be in a downward "V" shape. Alternatively, the bypass activating system 230 can be one or more extending members 232, or can comprise various other configurations complementary to the configuration of the bypass mechanism 320.

The socket assembly 300 comprises the socket 310 adapted to receive the light assembly 200. The socket 310 defines a cooperatively-shaped aperture 311 to receive at least the base 220 of the light assembly 200. The socket 310 can also be adapted to receive the whole of the bypass activating system 230 of the light assembly 200. The socket 310 can be arranged in many shapes and sizes, but the socket 310 should be of a shape to conveniently receive the light assembly 200.

The socket 310 includes a pair of socket terminals 312. The socket terminals 312 can be located on opposing inner sides of the socket 310. The socket 310 further includes a pair of terminal wires 314 extending to the exterior to allow energy to enter and exit the socket 310. Each socket terminal 312 can be essentially an extension of each respective terminal wire 314. The terminal wire 314 extends through the bottom of the socket 310 to ultimately connect to an electrical source. Therefore, the electrical current is introduced into the socket 310 by one of the terminal wires 314 and conducted either through the bypass mechanism 320, if the bypass mechanism 320 is in the first position, or through lead wires 222 to the filament 214 to illuminate the light bulb 210, if in the second position. Regardless of path, the current can flow to the other of the lamp systems 100 of the light string.

The bypass mechanism 320 of the socket assembly 300 includes a conductive element 322, which rests in the socket 310. The conductive element 322 has a first position and a second position corresponding to the first and second positions of the bypass mechanism 320.

For example and not limitation, the bypass mechanism 320 incorporates the conductive element 322, such that an electric circuit extends from a power source, such as for example a power outlet, to the left terminal wire 314, through the left socket terminal 312 across conductive element 322, and ultimately to the right terminal wire 314 via the right socket terminal 312.

In some embodiments, the conductive element 322 can be a spring mechanism 324. The socket 310 is dimensioned to receive the insertion of the bypass activating system 230, which can force portions of the single spring 324 together, not apart, when the light assembly 200 is inserted into the socket 310. In other words, the bypass activating system 230 can cause the conductive element 322 to spring inwardly, toward the center of the socket 310. The single spring 324 springs apart, not together, when the light assembly 200 is removed from the light socket 310.

When the light assembly 200 is inserted into the socket 310, the bypass activating system 230 pushes at least one side of the conductive element 322 away from the socket terminal 312 to "open" the circuit across 322. This disables the electrical connection that the bypass mechanism 320 created, and the circuit is closed via the bulb 210, as opposed to the conductive element 322. In an exemplary embodiment, both sides of the conductive element 322 can be disengaged by the bypass activating system 230. The bypass mechanism 320 can maintained in the socket assembly by grooves/cutouts formed within the socket and/or a holder placed in the socket.

The bypass activating system 230 can have one or more pointed or rounded tips that facilitate disconnecting the bypass mechanism 320 from the socket terminals 312. The bypass activating system 230 disables the physical connection of the bypass mechanism 320, thereby eliminating any electrically conductive path for the electrical current to flow, other than through the inserted light assembly 200.

The bypass mechanism 320 permits the removal of one or more light assemblies 200 of the lamp system 100, while maintaining the lighting of the remaining lights of a light string system, which is arranged in electrical series. When a light assembly 200 is missing from a socket 310, the bypass mechanism 320 creates a short circuit, and therefore enables current flow to continue to other lamp systems 100 within a light string. Each socket 310 can have a single current carrying bypass mechanism 320, which pushes away from the socket terminal 312 when the bypass activating system 230 engages the bypass mechanism 320, thereby breaking electrical continuity across the bypass mechanism 320. When the base 220 of the light assembly 200 is fully engaged in the socket 310, the lead wires 222 extending from the base 220 will make electrical contact with the socket terminals 312 completing the electrical circuit. When the light assembly 200 is removed, the bypass mechanism 320 again makes contact with the socket terminals 312, maintaining the electrical connection.

The bypass mechanism 320 has at least two positions—a first position and a second position. The first position bypasses energy flow when a light assembly 200 is burnt, missing, or not properly seated in the socket 310. In the first position, the bypass mechanism 320 extends to make contact with the sides of the socket 310, the socket terminals 312. As a result, an electrical circuit is created, or a short circuit is formed. This situation arises when the light assembly 200 is missing from or improperly seated in the socket 310. The second position enables energy to flow through the light source 210 to illuminate it. In the second position, the bypass mechanism 320 is removed from electrical communication from at least one side of the socket 310 (at least one of the socket terminals 312). The electrical circuit through the bypass mechanism 320 is disconnected, or an open circuit is formed. This situation typically arises when a light assembly 200 is fully inserted, and thus properly seated, in the socket 310. For instance, the bypass activating system 230 pushes the bypass mechanism 320 together when the light assembly 200 is seated in the socket 310; and the bypass mechanism 320 pushes apart when the light source 210 is removed from the socket 310.

A first exemplary embodiment of the present invention is illustrated in FIGS. 2-8, a second exemplary embodiment of the present invention is illustrated in FIG. 9-14, and a third exemplary embodiment of the present invention is illustrated in FIGS. 15A-19. Elements of the first, second, and third exemplary embodiments described herein can be used in other exemplary embodiments. In addition, the exemplary embodiments provide shunting systems to light string systems in the event of, among other things, an absent, broken, or improperly seated base or light assembly in the respective socket.

Figure 2:
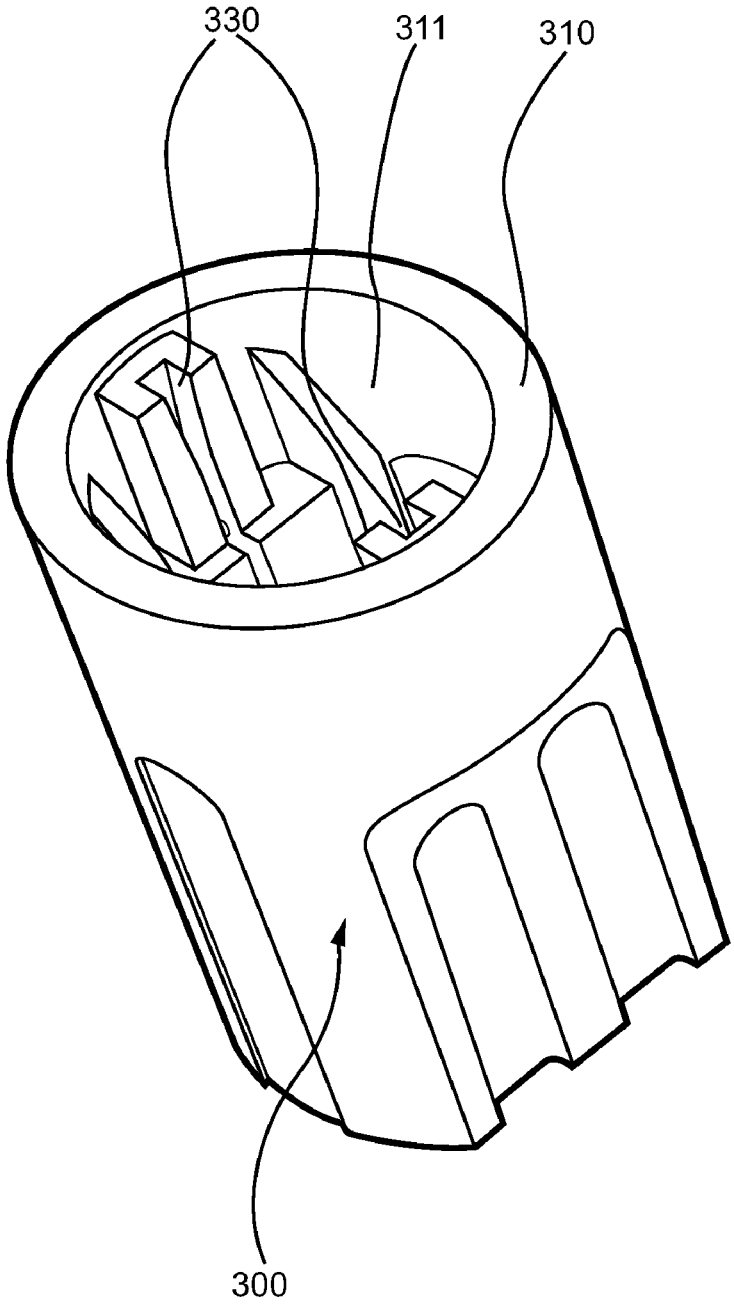
FIG. 2 is a side, top perspective view of a socket assembly, in accordance with an exemplary embodiment of the present invention.

FIGS. 2-8 are illustrations of an exemplary embodiment of the present invention. Referring initially to FIG. 2, it illustrates a top, perspective view of a socket assembly 300. The socket assembly 300 includes a socket 310 defining a hollow cavity 311, which is adapted to receive a portion of the base 220 (e.g., see FIG. 3) of the light assembly 200. The socket 310 can be made by way of many methods, for example and not limitation via an injection mold process. The socket 310 can include a pair of grooves or cutouts 330 on opposing interior sides. Each of the grooves/cutouts 330 extends from a top, near the lip or opening 318 of the socket 310, to a bottom, near a predetermined point within the socket 310.

Figure 4:
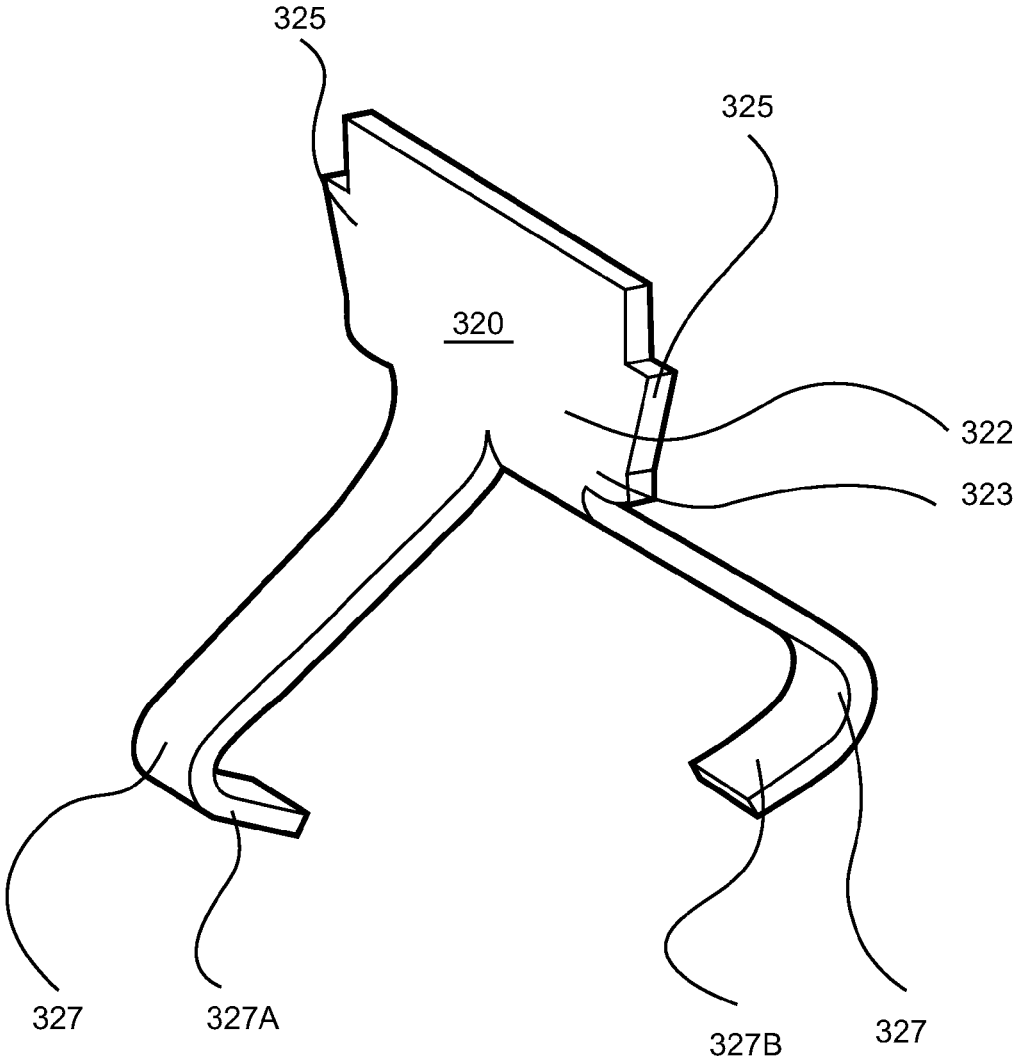
FIG. 4 is a side perspective view of a conductive element of a bypass mechanism, in accordance with an exemplary embodiment of the present invention.

FIG. 4 illustrates a perspective view of a bypass mechanism 320. The bypass mechanism 320 comprises a conductive element 322 made of a conductive material. The bypass mechanism 320 can have flexible, spring-like characteristics to move back-and-forth between the first position and the second position. The bypass mechanism 320 comprises a securing assembly 325 and a pair of movable arms 327. The securing assembly 325 is adapted to attach to the socket assembly. In an exemplary embodiment, the securing assembly 325 can be received and secured in the grooves/cutouts 330 of the socket 310. The securing assembly 325, when seated in the grooves/cutouts 330, ensures that it is properly seated in the socket 310 and capable of bypassing energy across the socket 310. As mentioned, the bypass mechanism 320 also includes a pair of arms 327A and 327B. Each arm 327 extends outwardly from an approximate center portion of the bypass mechanism 320. In some embodiments, each arm 327 extends approximately normal from the securing assembly, in order to contact the socket terminal 312.

In an exemplary embodiment, the bypass mechanism 320 is a resilient shaped spring 323 that is secured in the socket 310 by the keyed grooves/cutouts 330. The bypass mechanism 320 is thus placed between the two socket terminals 312 of the socket 310. In some embodiments, one end of the spring 323 can remain in constant contact with one of the socket terminals 312, while the other end of the spring 323 is in contact with the opposing socket terminal 312 when the base 220 the light assembly 200 is absent, missing, or improperly seated in the socket 310. In some embodiments, both ends of the spring 323 can move when the base 220 is inserted and seated in the socket 310. The spring 323 is in a relaxed state when it contacts the opposing socket terminals and is in a compressed state when the bypass activating system 230 contacts and disables the shunting across the socket 310. In some embodiments, the ends can be the arms 327A and 327B of the conductive element 322.

Figure 3:
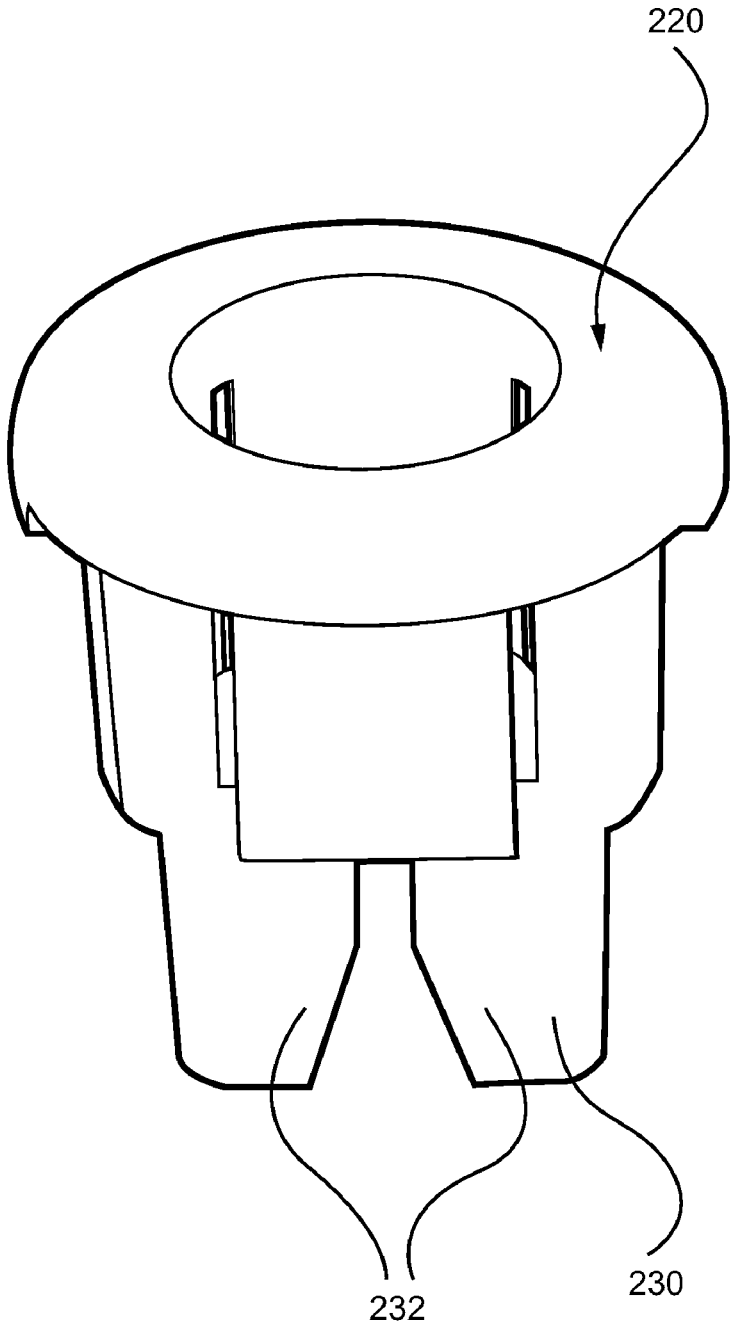
FIG. 3 is a side, top perspective view of a base of a light assembly, in accordance with an exemplary embodiment of the present invention.

FIG. 3 illustrates an exemplary base 220 of the light assembly 200. In operation, as the base 220 is inserted into the socket 310, a bypass activating system 230 contacts the bypass mechanism 320 to disable the shunt across the socket 310. The bypass activating system 230 includes one or more downwardly extending members 232 for contacting the bypass mechanism 320. In some embodiments, the downwardly extending member 232 can be a triangular-shaped prong or tooth on the bottom of the base 220.

In some embodiments, the downwardly extending member 232 can be an upside-down V-shaped assembly. The downwardly extending member 232, when the base 220 of the light assembly 200 is inserted into the socket 310, breaks the electrical contact between at least one end of the bypass mechanism 320 and the socket terminal 312 it was in contact with. When one or more of the ends of the bypass mechanism 320 is removed from contact with its respective socket terminal 312, an open circuit is created and energy no longer is shunted across the bypass mechanism 320. When the base 220 of the light assembly 200 is removed from the socket 310, the bypass activating system 230 is removed from the socket 310 and the end or ends of the bypass mechanism 320 resiliently returns to contact with the socket terminal(s) 312, enabling energy to bypass across the bypass mechanism 320.

Figure 5:
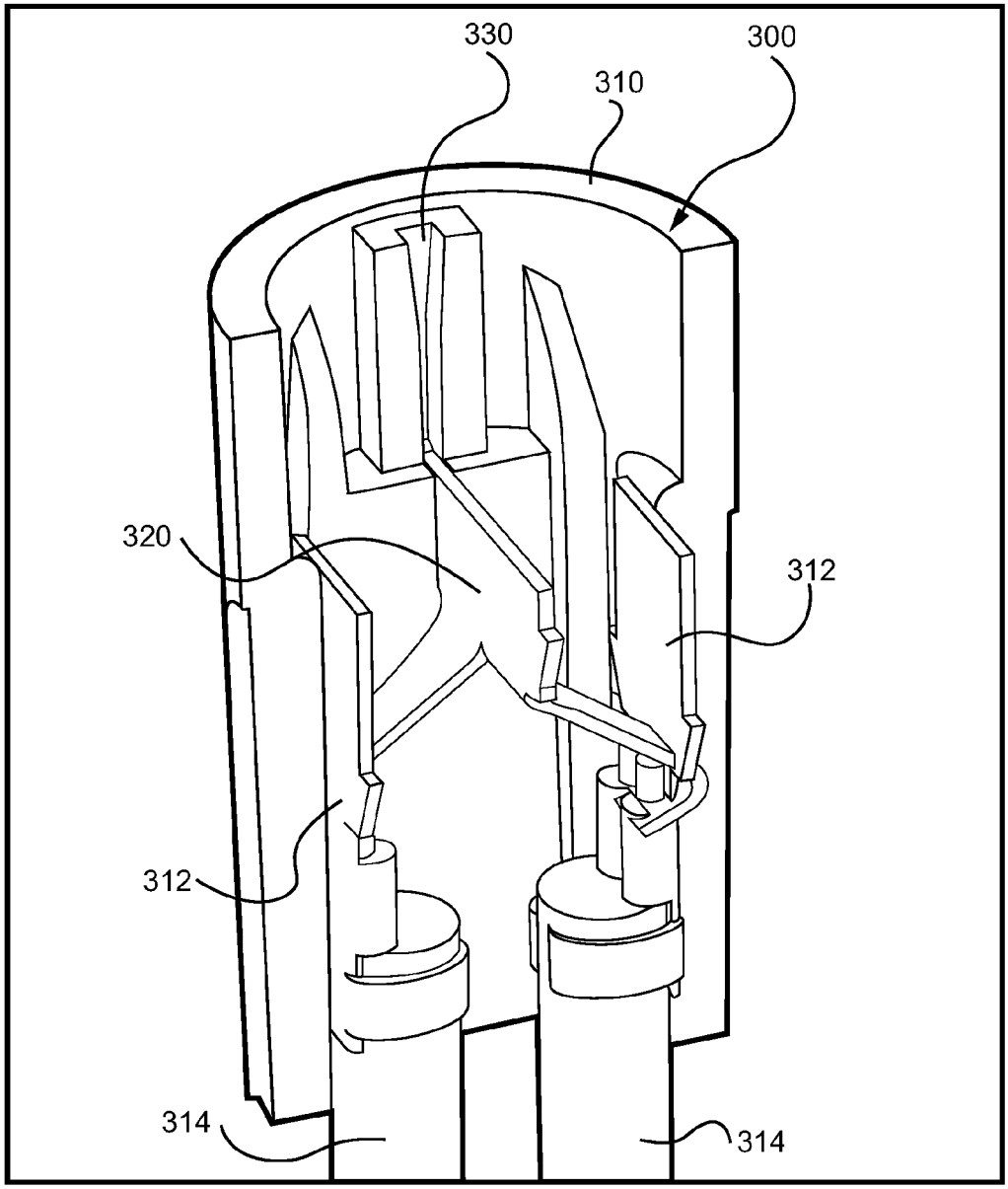
FIG. 5 is a partial cross-sectional, perspective view of the conductive element of the bypass mechanism of FIG. 4 seated in the socket assembly of FIG. 2, in accordance with an exemplary embodiment of the present invention.

FIG. 5 is a partial cross-sectional, perspective view of the bypass mechanism 320 of seated in the socket 310, in accordance with an exemplary embodiment of the present invention. The illustration of FIG. 5 shows the bypass mechanism 320 shunting the lamp system 100 and can allow energy to flow across the socket 310, and thus enables a series light string of lamp systems 100 to remain illuminated when energized with energy. In an exemplary embodiment, the bypass mechanism 320 spans the length of the diameter of the socket 310.

In an exemplary embodiment, FIG. 5 shows a shunted lamp system 100, such that when the light assembly 200 is missing from or improperly seated in the socket 310 energy can be transmitted to other lamp systems 100 in a light string. The shunted lamp system 100 enables energy to continue past the missing or improperly seated in the socket 310. In this arrangement, energy flows from a power source, e.g., a power outlet, to an electrical series or electrical parallel arranged light string system, wherein the light string system comprises a plurality of lamp systems 100. When the energy is moving through the lamp system 100, the energy flows through a first terminal wire 314, to a first socket terminal 312, across the bypass mechanism 320, to a second socket terminal 312, and out a second terminal wire 314 onto another lamp system 100.

Figure 6:
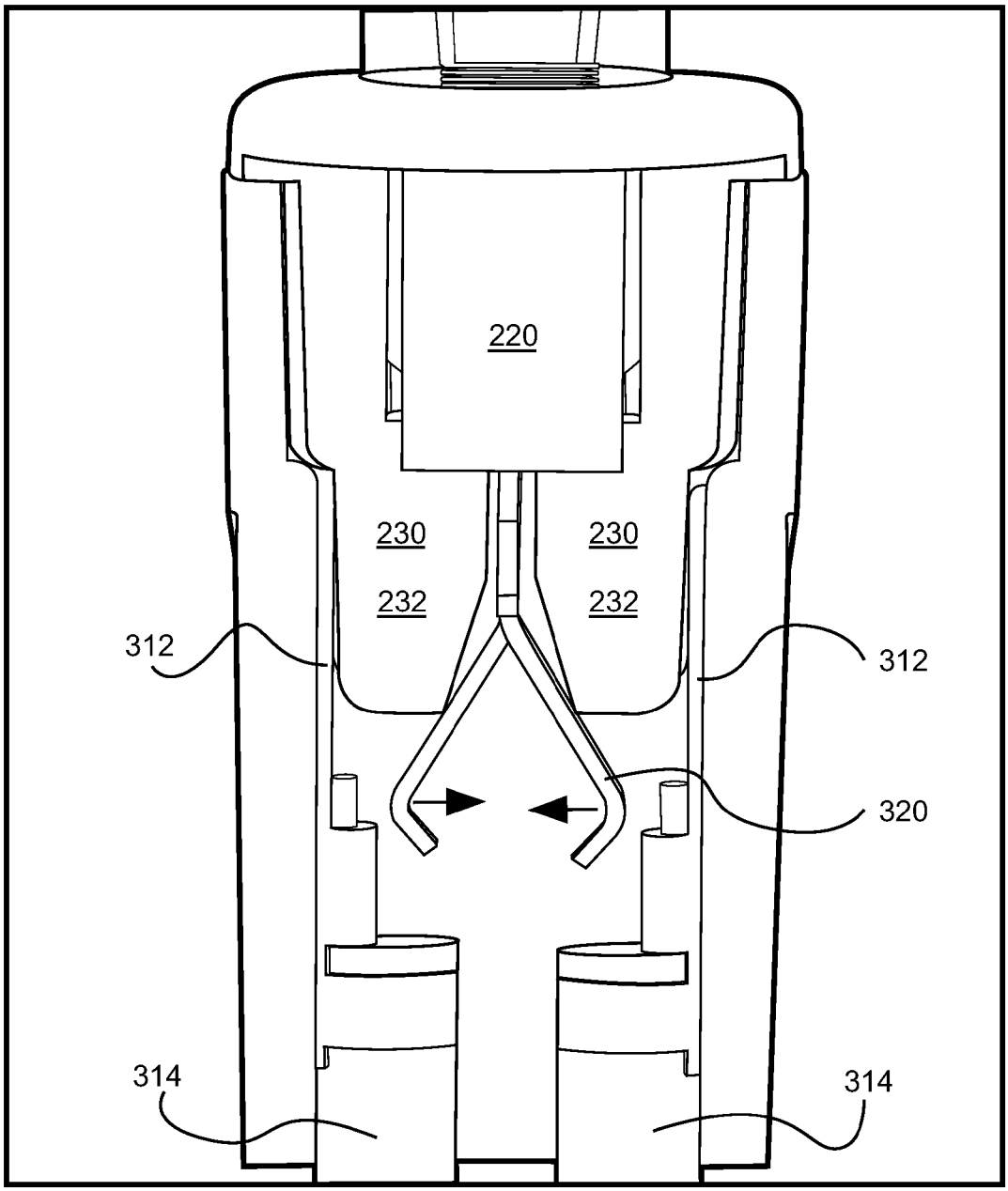
FIG. 6 is a partial cross-sectional view of the base of the light assembly of FIG. 3 seated in the socket assembly of FIG. 2 and disabling the shunting of the conductive element of the bypass mechanism of FIG. 4, in accordance with an exemplary embodiment of the present invention.
Figure 7:
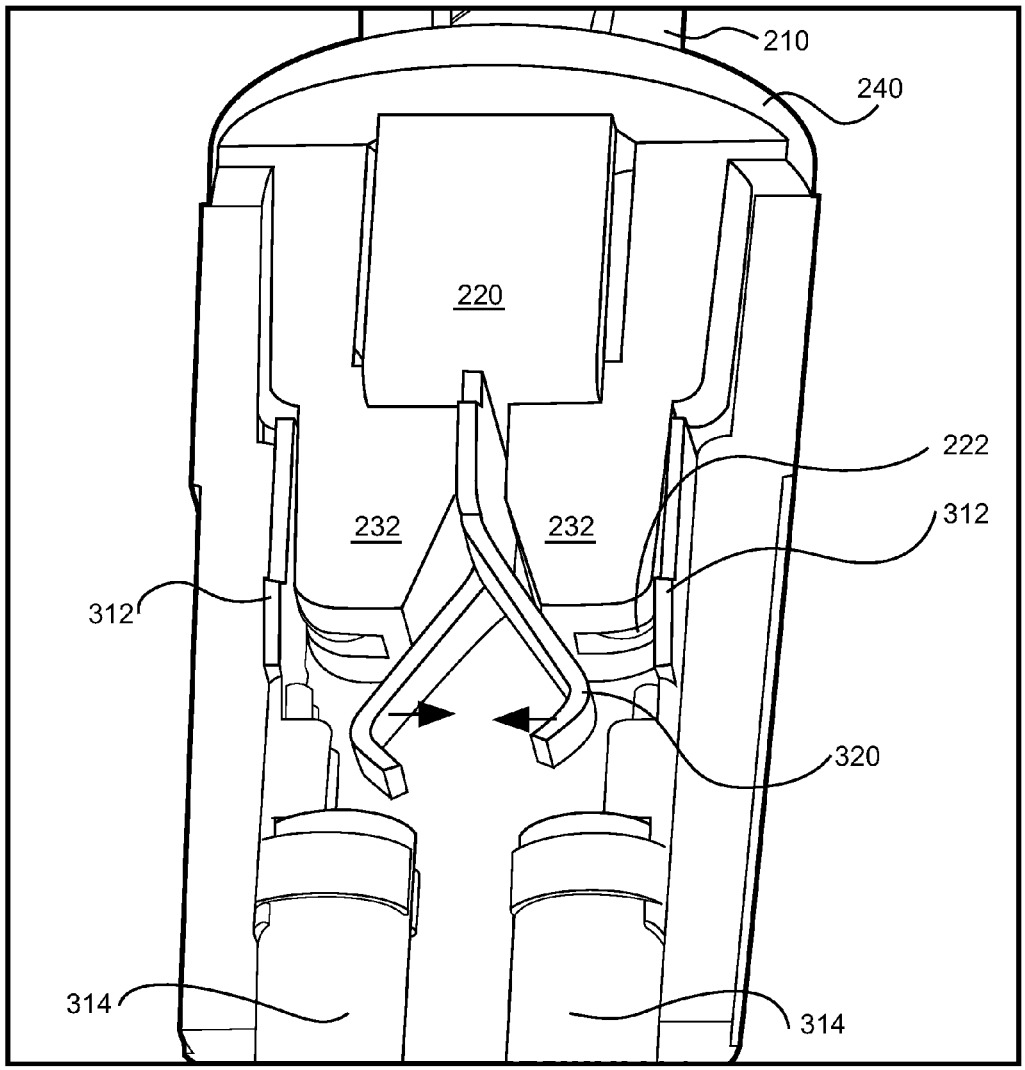
FIG. 7 is a partial cross-sectional, perspective view of the base of the light assembly of FIG. 3 seated in the socket assembly of FIG. 2 and disabling the shunting of the conductive element of the bypass mechanism of FIG. 4, in accordance with an exemplary embodiment of the present invention.

FIGS. 6-7 illustrate partial cross-sectional, perspective views of the base 220 of the light assembly 200 seated in the socket 310 and thus disabling the shunting of the bypass mechanism 320, in accordance with an exemplary embodiment of the present invention.

As illustrated in FIGS. 6-7, upon inserting a portion of the base 220 the light assembly 200 into the socket 310, the bypass activating system 230 extending from the base 220 contacts a portion of each arm of the bypass mechanism 320. As mentioned above, the bypass activating system 230 can comprise one or more downwardly extending members 232. Upon insertion, the downwardly extending member 232 moves at least one of the arms of the bypass mechanism 320 away from the socket terminals 312, e.g., inwardly towards the center of the socket 310.

In an exemplary embodiment, e.g., see FIGS. 3 and 6-7, the shape of the downwardly extending members 232 collectively make, generally, an upside-down V-shape. The V-shaped downwardly extending members contact the bypass mechanism 320 to disable the shunt. As a result, this creates an open circuit across the bypass mechanism 320 and permits energy to flow through the light assembly 200, as illustrated in FIGS. 6-7.

Figure 8:
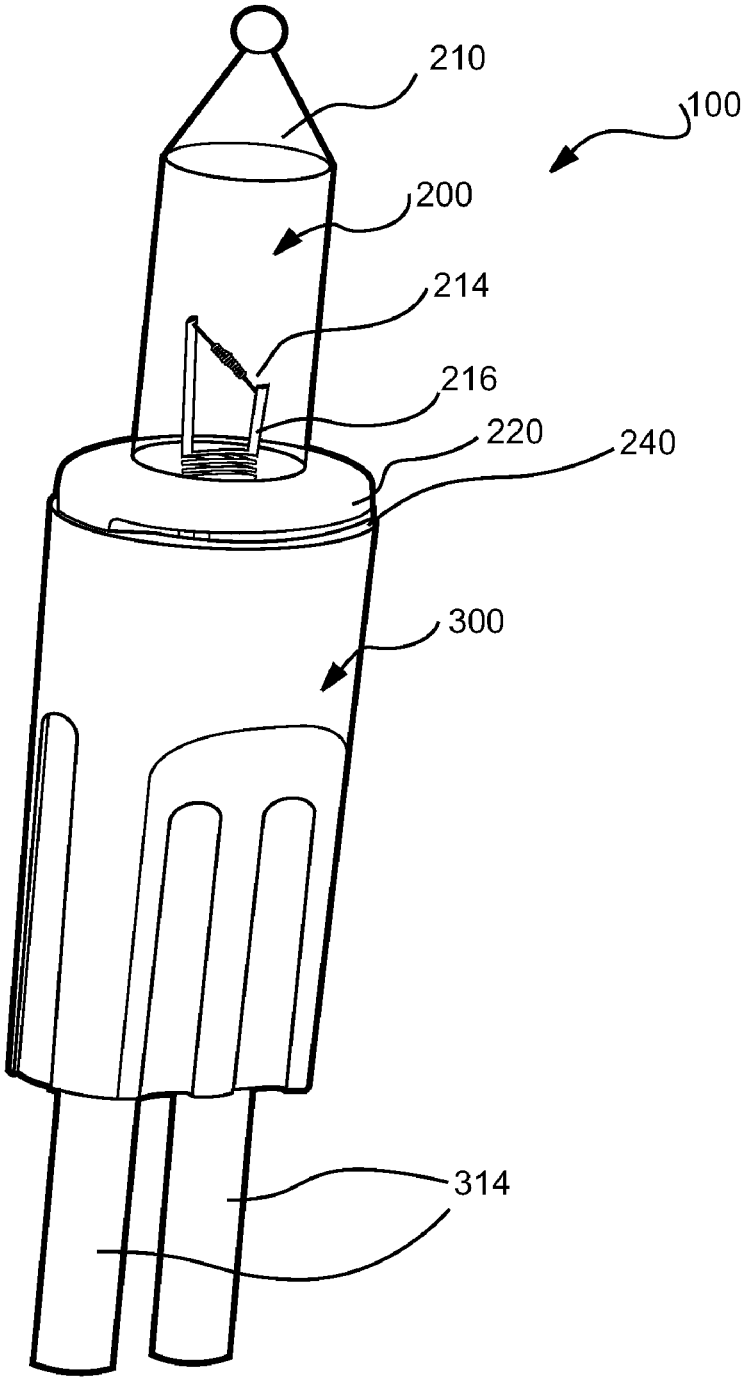
FIG. 8 is a perspective view of a fully assembled lamp system, in accordance with an exemplary embodiment of the present invention.
Figure 9:
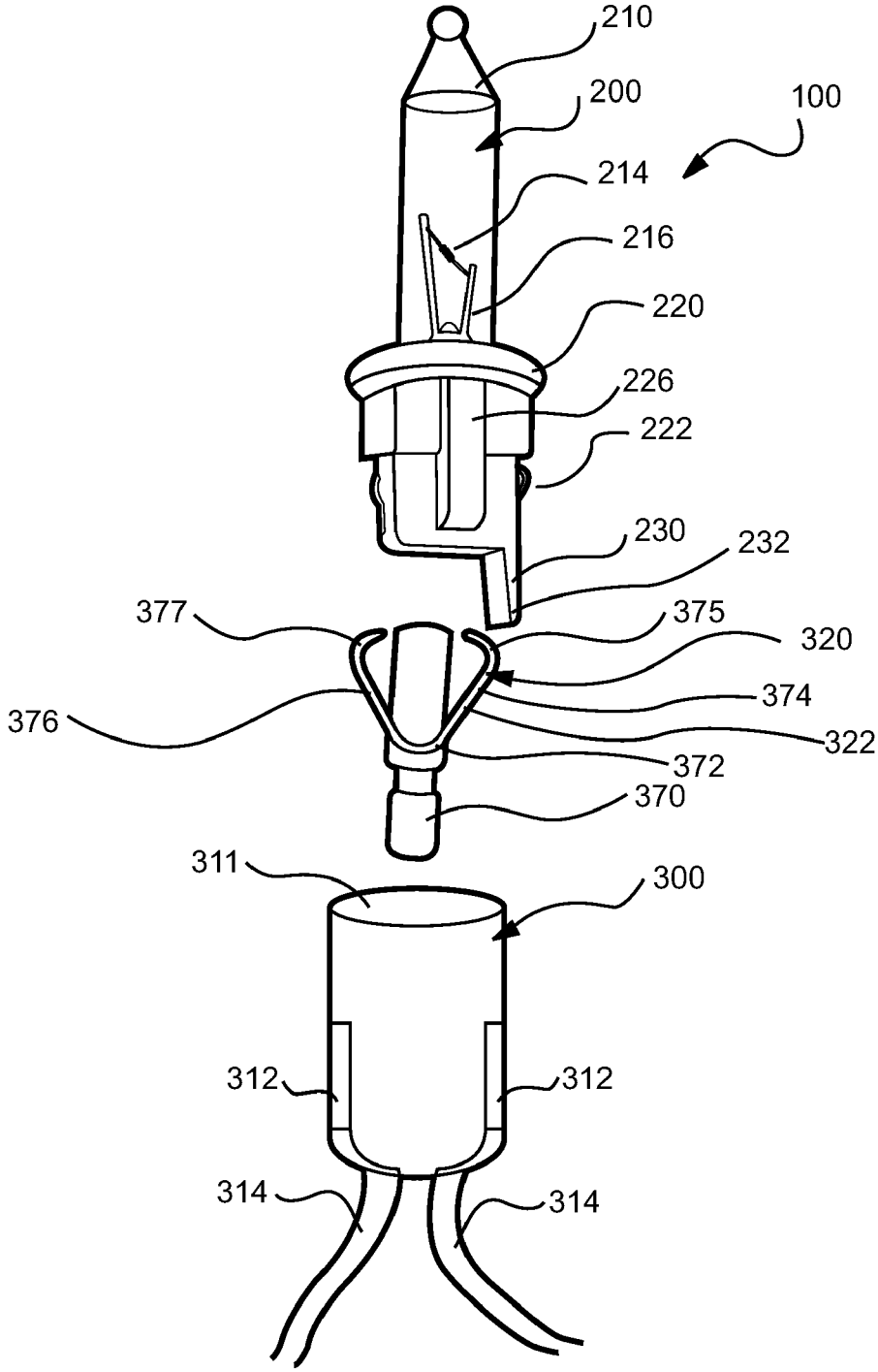
FIG. 9 is a side, perspective, exploded view of a lamp system, in accordance with another exemplary embodiment of the present invention.
Figure 10A:
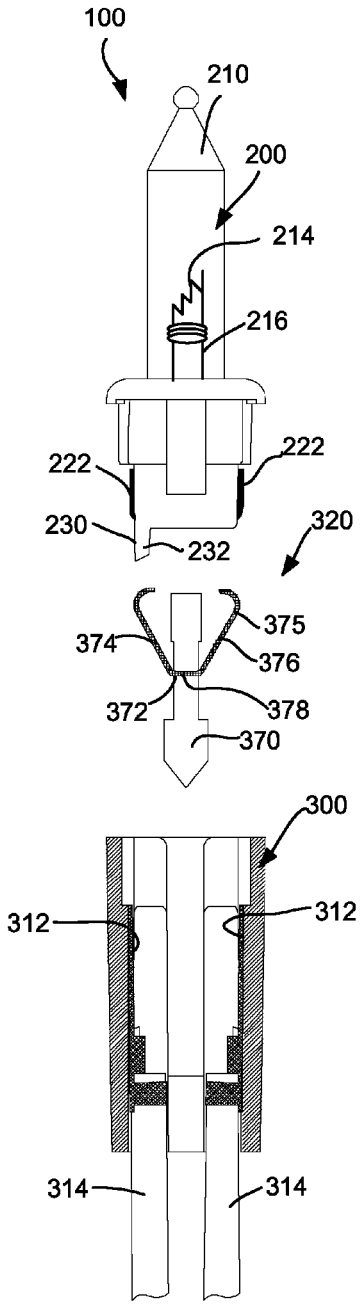
FIG. 10A is a side, partial exploded, partial cross-sectional view of the lamp system of FIG. 9, before insertion of the light assembly in the socket assembly, in accordance with an exemplary embodiment of the present invention.
Figure 10B:
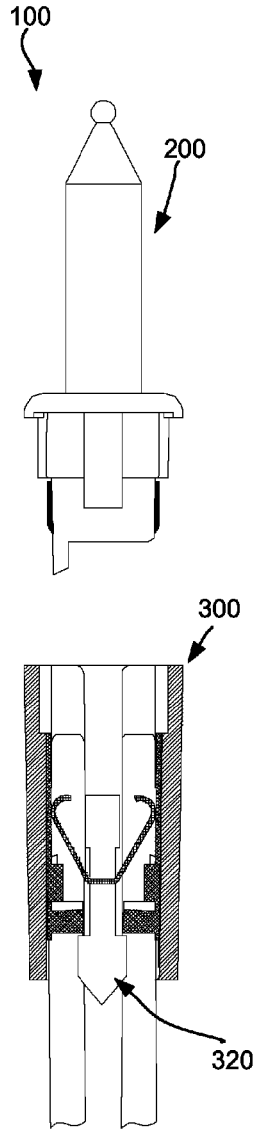
FIG. 10B is a side, partial cross-sectional view of the lamp system of FIGS. 9-10A, before insertion of the light assembly in the socket assembly with the bypass mechanism housed in to socket assembly, in accordance with an exemplary embodiment of the present invention.
Figure 10C:
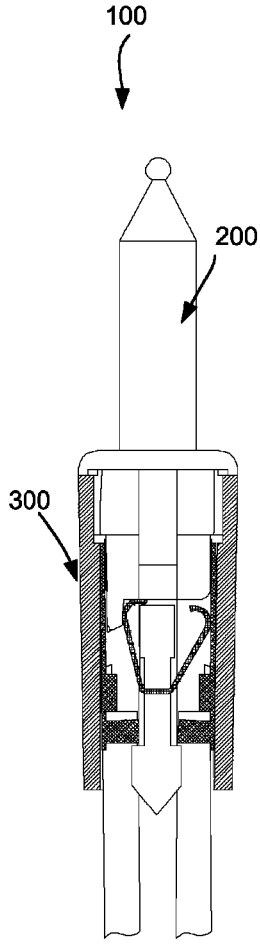
FIG. 10C is a side, partial cross-sectional view of the lamp system of FIGS. 9-10B illustrating the light assembly seated in the socket assembly, in accordance with an exemplary embodiment of the present invention.
Figures 11A, 11B, 11C, 11D:
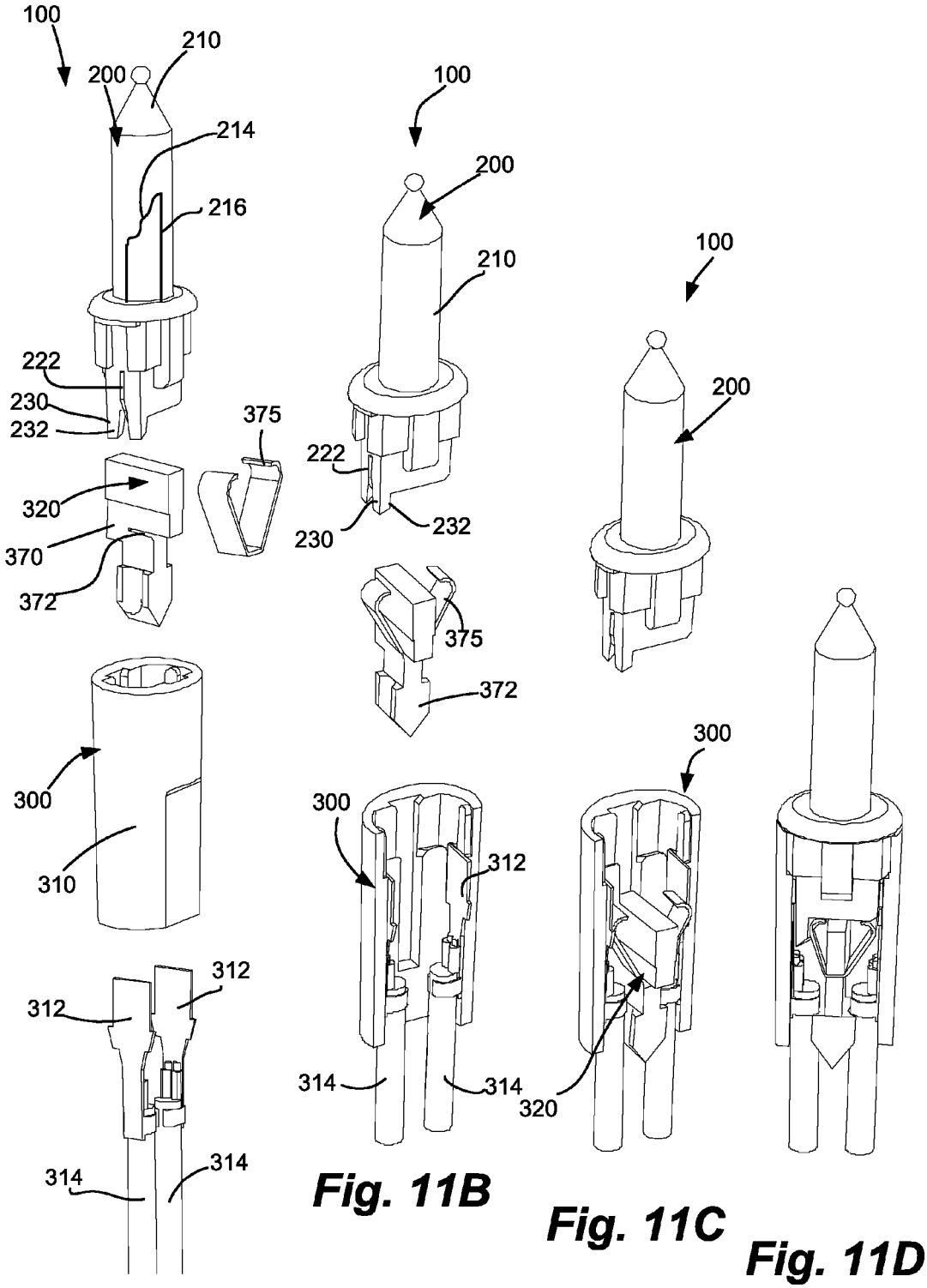
FIG. 11A is a perspective, exploded, partial cross-sectional view of the lamp system of FIGS. 9-10C before insertion of the light assembly and the bypass mechanism in the socket assembly, in accordance with an exemplary embodiment of the present invention.
FIG. 11B is a perspective, exploded, partial cross-sectional view of the lamp system of FIGS. 9-11A before insertion of the light assembly and the bypass mechanism, with the bypass mechanism assembled, in accordance with an exemplary embodiment of the present invention.
FIG. 11C is a perspective, partial cross-sectional view of the lamp system of FIGS. 9-11B before insertion of the light assembly into the socket assembly, with the bypass mechanism assembled housed in the socket assembly, in accordance with an exemplary embodiment of the present invention.
FIG. 11D is a side, partial cross-sectional view of the lamp system of FIGS. 9-11C with the light assembly seated in the socket assembly, in accordance with an exemplary embodiment of the present invention.
Figure 12A:
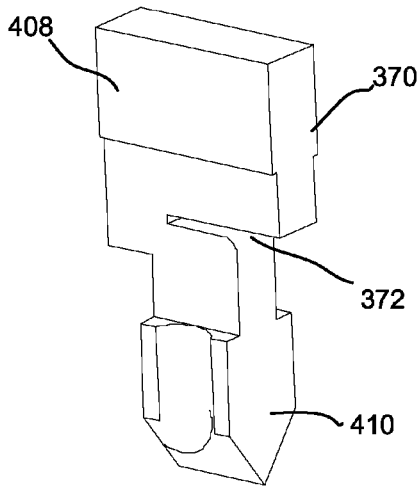
FIG. 12A is a perspective view of a holder of the bypass mechanism of FIGS. 9-11D, in accordance with an exemplary embodiment of the present invention.
Figure 12B:
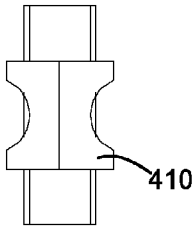
FIG. 12B is a bottom view of the holder of FIG. 12A, in accordance with an exemplary embodiment of the present invention.
Figure 12C:
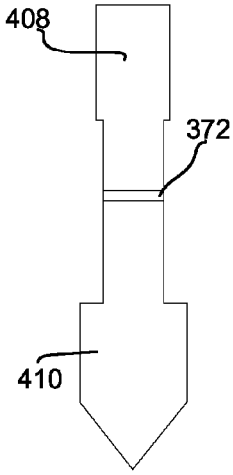
FIG. 12C is a front view of the holder of FIGS. 12A-12B, in accordance with an exemplary embodiment of the present invention.
Figure 12D:
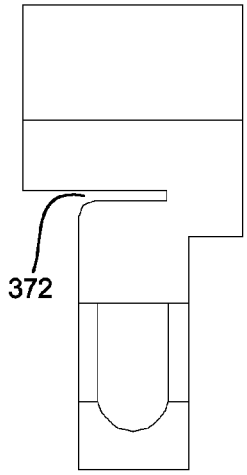
FIG. 12D is a side view of the holder of FIGS. 12A-12C, in accordance with an exemplary embodiment of the present invention.
Figure 12E:
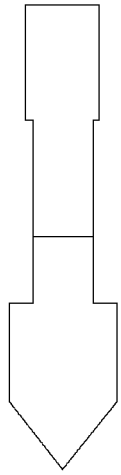
FIG. 12E is a rear view of the holder of FIGS. 12A-12D, in accordance with an exemplary embodiment of the present invention.

FIG. 8 illustrates an exterior view of the fully-assembled lamp system 100, such that the light assembly 200 is fully inserted and properly seated in the socket 310. In this arrangement, the bypass mechanism 320 is open and energy can flow through the light assembly 200. For example, energy can flow through a first terminal wire 314, to a first socket terminal 312, through a first lead wire 222, through a first conductor 216, across a filament 214 of the light assembly 200, through a second conductor 216, through a second lead wire 222, to a second socket terminal 312, and out the lamp system 100 via a second terminal wire 314.

In other words, FIG. 8 illustrates a fully-assembled lamp system 100, illustrating the light assembly 200 being inserted into and properly seated in the socket 310. As the light assembly 200 is inserted into the socket 310, electrical current flowing through the bypass mechanism 320 is interrupted. When physical contact between bypass mechanism 320 is broken by the bypass activating system 230, electrical current flow is then enabled to flow through the lead wires 222 and up through the conductors 216 to illuminate the light source 210.

The current then resumes flowing out through the opposite side of the conductor 216 and down through the other lead wire 222, passing through the other terminal wire 314 until it exits that particular lamp system 100. A flange 240 engages the socket 310 when light assembly 200 is fully seated. The illustrated lamp system 100 of FIG. 8 is capable of being lit, because the light assembly 200 is properly seated in the socket assembly 300.

FIGS. 9-14 illustrate an alternative embodiment of the present invention. Like the embodiment described above, and shown in FIGS. 2-8, the embodiment illustrated in FIGS. 9-14 can bypass energy across a lamp system. The lamp system 100 of FIGS. 9-14 comprises a light assembly 200 and a socket assembly 300. The light assembly 200 comprises a light source 210, a base 220, and a bypass activating system 230. The socket assembly 300 comprises a socket 310 and a bypass mechanism 320. The bypass mechanism 320 comprises a holder 370 and a conductive element 322.

In an exemplary embodiment, the bypass mechanism 320 comprises both a holder 370 and a conductive element 322. The conductive element 322 can be carried by the holder 370 in the socket 310. In an exemplary embodiment, the holder 370 is symmetrical along at least its length. The holder 370 includes a cutout 372, which receives and secures the conductive element 322 near the approximate midpoint of the conductive element 322.

The conductive element 322 of the bypass mechanism 320 includes opposing arms 374, 376 that are bent in proximity to each end 375, 377, collectively forming generally a "V" shape.

Figure 13:
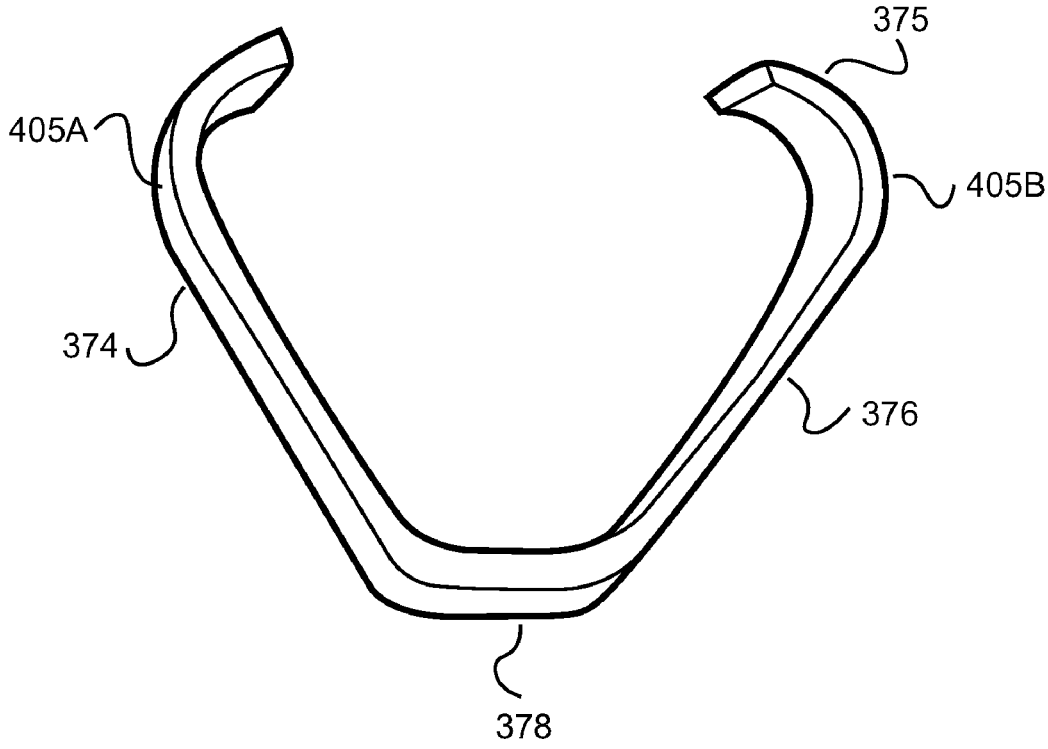
FIG. 13 is a side, perspective view of a conductive element of the bypass mechanism of the lamp system of FIGS. 9-11D, in accordance with an exemplary embodiment of the present invention.

In some embodiments, the conductive element 322 can incorporate a specific shape. The shape of the conductive element 322 provides an integral piece of conductive material, such as copper, that is bent or pressed into a preferred shape. As mentioned, the conductive element 322 includes a pair of arms 374 and 376, which are bent in proximity to each end 375 and 377, respectively. In some embodiments, and as illustrated in FIG. 13, each arm 374 and 376 is bent at a single point 405A and 405B, respectively, and then the two arms meet at a flat section 378. Moving from one end to another, the conductive element 322 is bent or pressed at least three sections: points 405A, 405B, and flat section 378. The angles at points 405A and 405B can be approximately 90 degrees, but do not form a right angle, instead it is more of a gradual bending point—the point can be curved not pointed as illustrated in FIG. 13. The arms 374 and 376 extend to the flat section 378, which is angled approximately 45 degrees from the arms 374 and 376. The arms 374 and 376 are flexible relative to the flat section 378, such that when the bypass mechanism is inserted into the socket 310, it contacts at approximately one of the points 405A or 405B, and upon this contact or strike, the respective arm 374 or 376 of the conductive element 375 biases inwardly and thus disconnects the bypass across the socket 310.

The flat section 378 of the conductive element 375 can be housed or fit into a cutout 372 of the holder 370. In an exemplary embodiment, the cutout 372 is keyed to receive the flat section 378. For example, the shape of the cutout 372 matches the flat section 378. For instance, the cutout can be substantially flat in shape or a straight cutout across the width of the holder 370.

Figure 14:
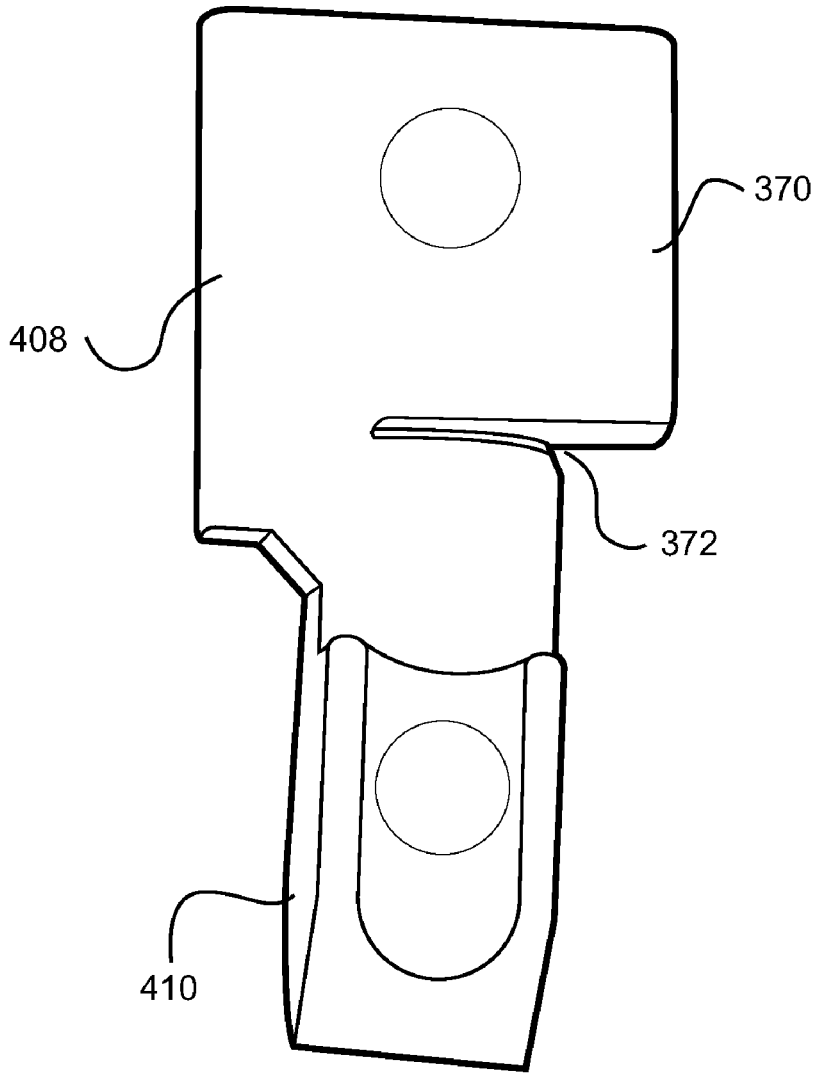
FIG. 14 is side, perspective view of the holder of a bypass mechanism of the lamp system of FIGS. 9-12E in accordance with an exemplary embodiment of the present invention.
Figure 15A:
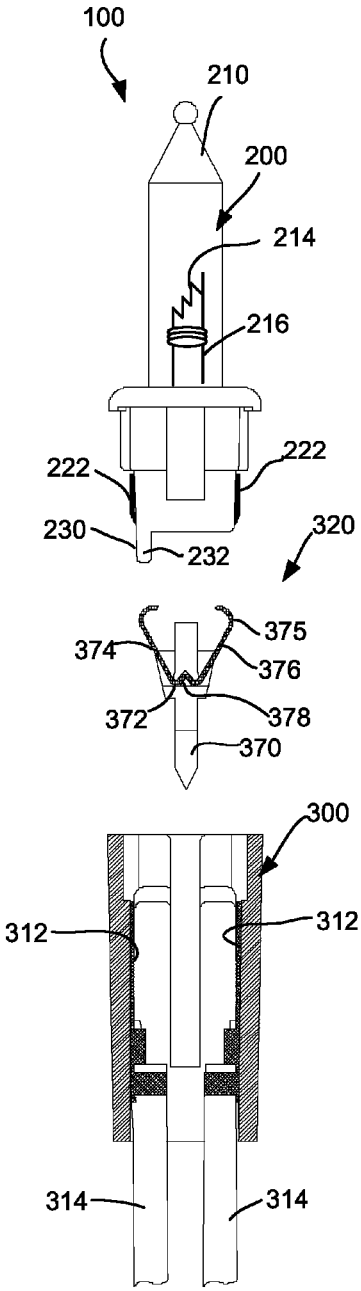
FIG. 15A is a side, exploded, partial cross-sectional view of a lamp system, before insertion of the light assembly in the socket assembly, in accordance with an exemplary embodiment of the present invention.
Figure 15B:
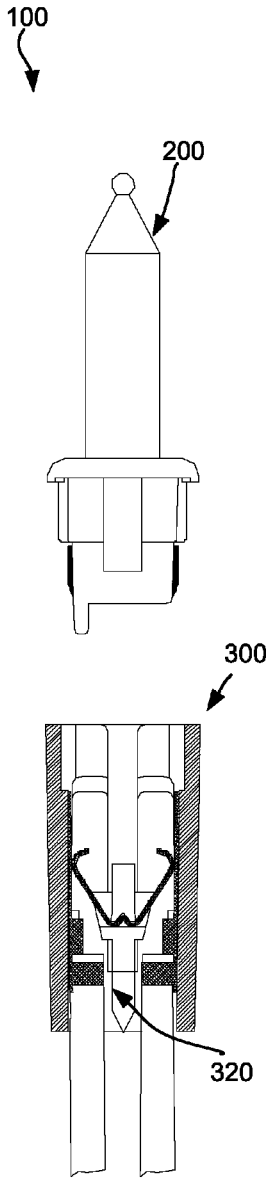
FIG. 15B is a side, partial cross-sectional view of a lamp system of FIG. 15A, before insertion of the light assembly in the socket assembly, in accordance with an exemplary embodiment of the present invention.
Figure 15C:
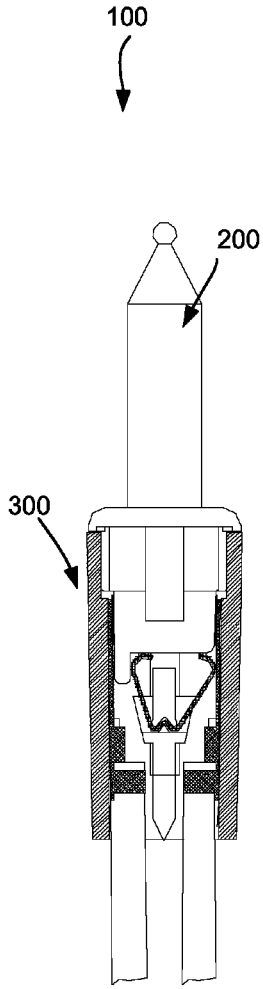
FIG. 15C is a side, partial cross-sectional view of the lamp system of FIGS. 15A-15B illustrating the seating of the light assembly in the socket assembly, in accordance with an exemplary embodiment of the present invention.
Figures 16A, 16B, 16C, 16D:
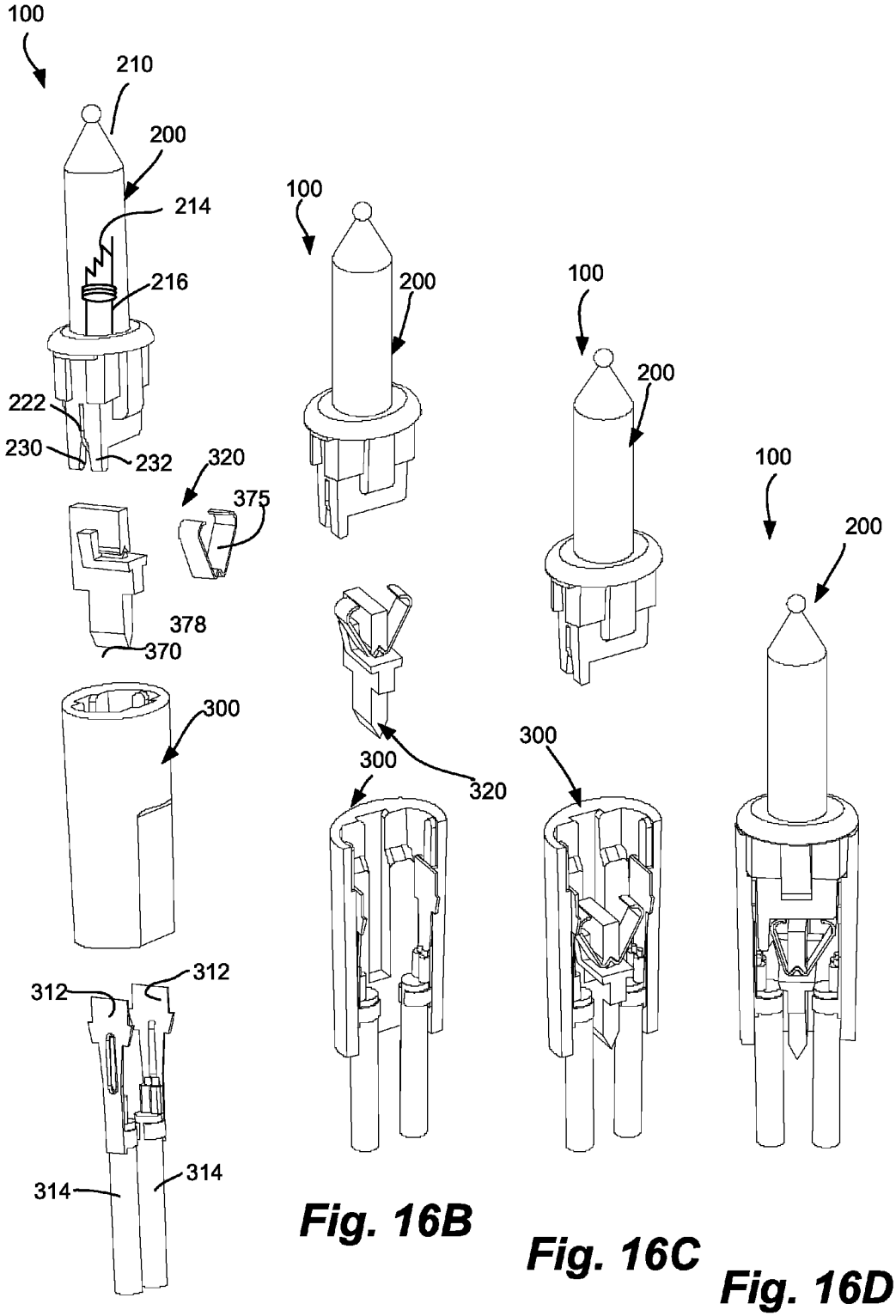
FIG. 16A is a perspective, exploded, partial cross-sectional view of the lamp system of FIGS. 15A-15C before insertion of the light assembly and the bypass mechanism in the socket assembly, in accordance with an exemplary embodiment of the present invention.
FIG. 16B is a perspective, exploded, partial cross-sectional view of the lamp system of FIGS. 15A-16A before insertion of the light assembly and the bypass mechanism, with the bypass mechanism assembled, in accordance with an exemplary embodiment of the present invention.
FIG. 16C is a perspective, partial cross-sectional view of the lamp system of FIGS. 15A-16B before insertion of the light assembly into the socket assembly, with the bypass mechanism assembled and housed in the socket assembly, in accordance with an exemplary embodiment of the present invention.
FIG. 16D is a side, partial cross-sectional view of the lamp system of FIGS. 15A-16C with the light assembly seated in the socket assembly, in accordance with an exemplary embodiment of the present invention.
Figure 17A:
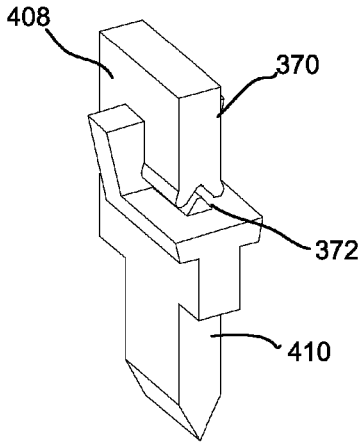
FIG. 17A is a perspective view of a holder of the bypass mechanism of FIGS. 15A-16D, in accordance with an exemplary embodiment of the present invention.
Figure 17B:
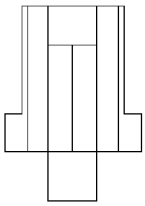
FIG. 17B is a bottom view of the holder of FIG. 17A, in accordance with an exemplary embodiment of the present invention.
Figure 17C:
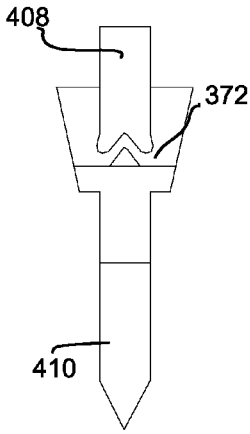
FIG. 17C is a front view of the holder of FIGS. 17A-17B, in accordance with an exemplary embodiment of the present invention.
Figure 17D:
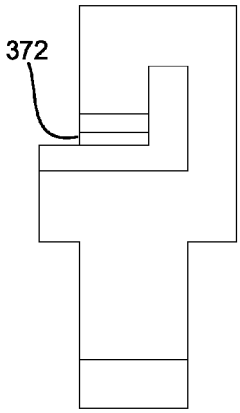
FIG. 17D is a side view of the holder of FIGS. 17A-17C, in accordance with an exemplary embodiment of the present invention.
Figure 17E:
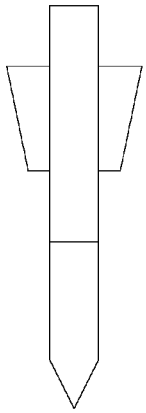
FIG. 17E is a rear view of the holder of FIGS. 17A-17D, in accordance with an exemplary embodiment of the present invention.

As illustrated in FIG. 14, the holder 370 includes an upper section 408 and a lower section 410. In an exemplary embodiment, the holder 370 can be symmetrical along its length. In an exemplary embodiment, the holder 370 can be symmetrical along its width. In another exemplary embodiment, the holder 370 can be symmetrical along both its height and its width. The upper section 408 extends up and into the socket 310 and fits between the arms 374 and 376 when the conductive element 375 is seated in the cutout 372 of the holder 370. The lower section 410 sits between the two terminal wires 314 and can, in some embodiments, provide a fluid sealing means to prevent water and other environmental objects from entering the bottom portion of the socket 310.

When the light assembly 200 is absent from the socket 310, the arms 374, 376 of the conductive element 375 contact the opposing socket terminals 312 of the socket 310 to bypass energy across the lamp system 100. When the light assembly 200 is inserted into the socket 310, at least one downwardly extending member 232 of the bypass activating system 230 contacts one arm of the conductive element 322 of the bypass mechanism 320 to open the bypass and permit energy to flow through the light assembly 200.

The holder 370 of the bypass mechanism 320 in the socket 310 has the ability to seal the socket 310. For instance, the holder 370 can protect the socket 310 from its environment. The holder 370 can limit, if not eliminate, moisture, water, and the like from entering the socket 310, e.g., the bottom of the socket 310. Alternatively, the holder 370 can further act as a base support for the bypass mechanism 320.

The holder 370 can be positioned between the two wires 314 and can carry the bypass mechanism 340. The holder 370 is positioned and designed as to not interfere with the bypass activating system 230 engaging the bypass mechanism 320.

In some embodiments, the holder 370 can have a cup-like shape. A bottom of the holder 370 can be substantially flat. The holder 370 includes the slit or cutout 372 for receiving and carrying the conductive element 322. The holder 370 can be made of plastic, and the holder 370 can be made of plastic, polymers, and the like. In some embodiments, the holder 370 can be made via a molding process.

FIGS. 15-19 illustrate various views of another design of a bypass socket system. The characteristics of the design shown in FIGS. 15-19 are similar to the design shown in FIGS. 9-14, except for the shape of the cutout 372 and the conductive element 375 that can be carried by the cutout 372.

In certain situations it may be desirable to secure the conductive element 375 in the cutout 372 in a more securing manner than that of FIGS. 9-14. The embodiment of FIGS. 15A-19 may, in some cases, provide a more stable securing means than that of FIGS. 9-14. In an exemplary embodiment, the conductive element 375 has a general "W" shape, as shown. The approximate center portion of the conductive element 375 can be inserted into the cutout 372. Because there are more contact points and angles, the conductive element is secured safely and can be carried by the holder 370.

The bypassing of the socket of FIGS. 15A-16D is generally the same as described for the FIGS. 9-11D. The shape of the conductive element is different.

Figure 18:
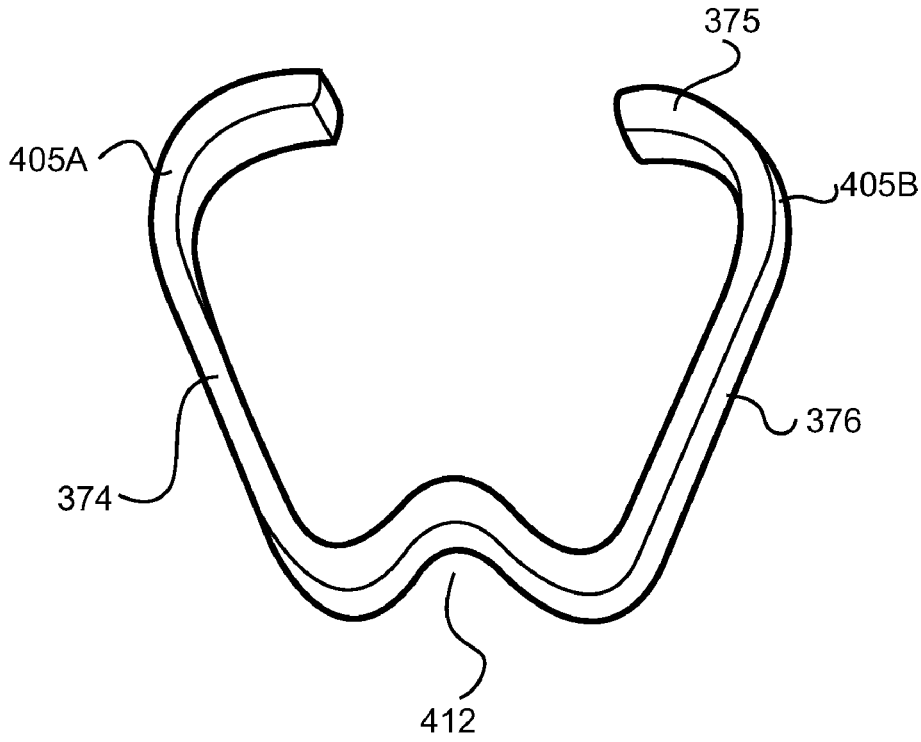
FIG. 18 is a side, perspective view of a conductive element of the bypass mechanism of the lamp system of FIGS. 15A-16D, in accordance with an exemplary embodiment of the present invention.

FIG. 18 illustrates an exemplary conductive element in accordance with exemplary embodiments of the present invention. The conductive element 375 includes a pair of arms 374 and 376. Each arm is bent at points 405A and 405B, respectively. This bending points 405A and 405B is closer to the arms termination points of the conductive element than its center point. Each bending point 405A and 405B is approximately 90 degrees. In fact, the bending points 405A and 405B in some embodiments can have the same angle as described for the conductive element of FIG. 11. Unlike the conductive element of FIG. 11, however, the conductive element illustrated in FIG. 14 does not include a flat section. Instead, the conductive element 375 of FIG. 14 includes a wave section 412. This wave section 412 generates the "W" shape of the conductive element 375 of FIG. 18.

Figure 19:
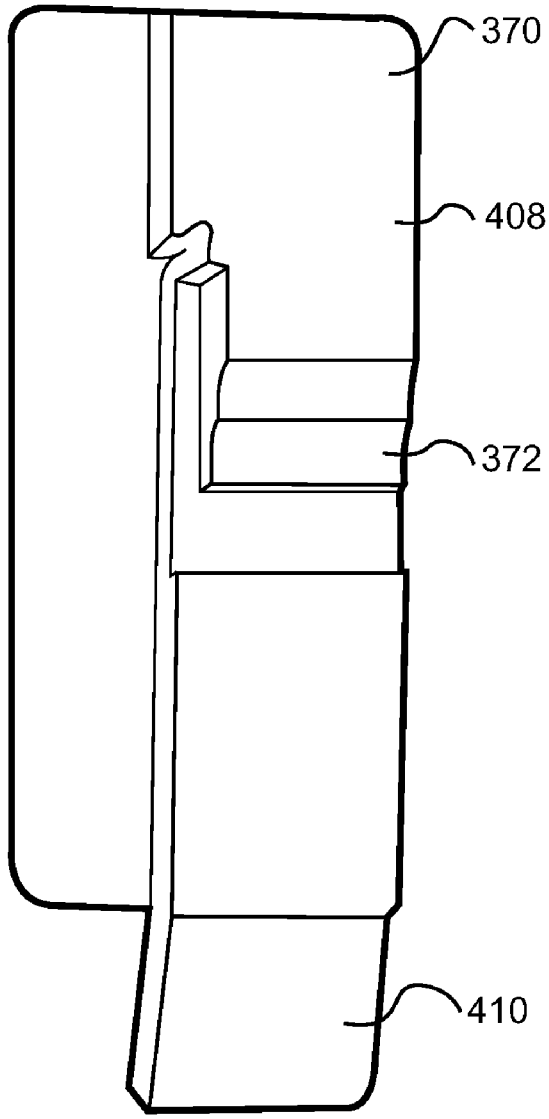
FIG. 19 is side, perspective view of the holder of a bypass mechanism of the lamp system of FIGS. 15A-17E, in accordance with an exemplary embodiment of the present invention.

Likewise, the holder 370 includes a cutout 372 that is keyed to the shape of the wave section 412, as shown in FIG. 19. The wave section 372 is fittable and securable within the cutout 372 of the holder 370.

Like the embodiment shown in FIG. 14, the holder 370 of FIG. 19 includes an upper section 408 and a lower section 410. In an exemplary embodiment, the holder 370 can be symmetrical along its length. In an exemplary embodiment, the holder 370 can be symmetrical along its width. In another exemplary embodiment, the holder 370 can be symmetrical along both its height and its width. The upper section 408 extends up and into the socket 310 and fits between the arms 374 and 376 when the conductive element 375 is seated in the cutout 372 of the holder 370. The lower section 410 sits between the two terminal wires 314 and can, in some embodiments, provide a fluid sealing means to prevent water and other environmental objects from entering the bottom portion of the socket 310.

Herein, the use of terms such as "including" or "includes" is open-ended and is intended to have the same meaning as terms such as "comprising" or "comprises" and not preclude the presence of other structure, material, or acts. Similarly, though the use of terms such as "can" or "may" is intended to be open-ended and to reflect that structure, material, or acts are not necessary, the failure to use such terms is not intended to reflect that structure, material, or acts are essential. To the extent that structure, material, or acts are presently considered to be essential, they are identified as such.

While exemplary embodiments of the invention have been disclosed many modifications, additions, and deletions can be made therein without departing from the spirit and scope of the invention and its equivalents, as set forth in the following claims.

What is claimed is:

1. A lamp system comprising:

a light assembly comprising a light source and a base, the base comprising a bypass activating system extending downwardly from the base, the bypass activating system comprising a first downwardly extending member;

a socket assembly dimensioned to receive via insertion at least a portion of the base of the light assembly, a bypass mechanism fittable within the socket assembly and comprising a holder and conductive element, the holder includes a cutout along its width adapted to receive and carry the conductive element therein, the conductive element comprising a pair of arms extending the length of the diameter of the socket, wherein one or both of the arms of the conductive element is moveable between a first position and a second position, wherein when the conductive element is in the first position, current flow is bypassed from the light assembly, and across the socket assembly, wherein in the second position, current flow is directed through the light assembly, wherein upon insertion of the base of the light assembly into the socket assembly, the first downwardly extending member of the bypass activating system activates one arm of the conductive element, disengaging it from a first internal side wall of the socket assembly, wherein the bypass mechanism is placed in the second position, and wherein upon removal of the base of the light assembly from the socket assembly, the first arm of the conductive element returns to engagement with the first and second internal side walls of the socket assembly, wherein the bypass mechanism is placed in the first position.

2. The lamp system of claim 1, the conductive element having a substantially "V" shape, and the cutout of the holder keyed to receive a portion of the conductive element therein for carrying the conductive element.

3. The lamp system of claim 1, the conductive element having a substantially "W" shape and the cutout of the holder keyed to receive a portion of the conductive element therein for carrying the conductive element.

4. The lamp system of claim 1, the holder comprising an upper portion and a lower portion, wherein the upper portion sits in the socket between the arms of the conductive element and between the first and second internal side walls of the socket.

5. The lamp system of claim 4, the lower portion sits between a pair of terminal wires.

6. The lamp system of claim 5, the lower portion provides a seal for the bottom of the socket.

7. The lamp system of claim 1, the conductive element comprising a single copper strand, the copper strand bent at least three separate positions to form a substantial V shape.

8. The lamp system of claim 1, the conductive element comprising a single copper strand, the copper strand bent at least five separate positions to form a substantial W shape.

9. The lamp system of claim 1, the socket assembly having a pair of socket terminals therein, wherein the first and second internal side walls are in electrical communication with the pair of socket terminals.

10. A lamp system for a light string system, the lamp system comprising:

a light assembly comprising:

a light source; and a base comprising a bypass activating system extending downwardly from the base and away from the light source;

a socket assembly comprising a socket dimensioned to receive via insertion a portion of the base of the light assembly, the socket assembly including a pair of contacting members positioned co-planar relative to opposing sides of the socket, the socket assembly incorporating a bypass mechanism moveable between a first position and a second position, the bypass mechanism comprising a conductive element carried by a holder, the holder defining a cutout adapted to receive a portion of the conductive element, the conductive element having a first position and a second position moveable based on the seating of the base in the socket, wherein when the conductive element is in the first position, current flow is bypassed from the light assembly, and across the socket assembly, such that a first arm of the conductive element is in electrical communication with a first contacting member of the socket, and a second arm is in electrical communication with a second contacting member of the socket, wherein in the second position, current flow is directed through the light assembly, such that upon insertion of the base of the light assembly into the socket assembly, the bypass activating system activates the bypass mechanism disengaging the first arm of the conductive element from the first contacting member of the socket assembly, and wherein, upon removal of the base of the light assembly from the socket assembly, the first arm of the conductive element returns to engagement with the first contacting member, and the bypass mechanism is placed in the first position.

11. The lamp system of claim 10, the conductive element having a substantially "V" shape, and the cutout of the holder keyed to receive a portion of the conductive element therein for carrying the conductive element.

12. The lamp system of claim 10, the conductive element having a substantially "W" shape and the cutout of the holder keyed to receive a portion of the conductive element therein for carrying the conductive element.

13. The lamp system of claim 10, the holder comprising an upper portion and a lower portion, wherein the upper portion sits in the socket between the arms of the conductive element and between the first and second internal side walls of the socket.

14. The lamp system of claim 13, the lower portion sits between a pair of terminal wires.

15. The lamp system of claim 14, the lower portion provides a seal for the bottom of the socket.

16. The lamp system of claim 10, the conductive element comprising a single copper strand, the copper strand bent at least three separate positions to form a substantial V shape.

17. The lamp system of claim 10, the conductive element comprising a single copper strand, the copper strand bent at least five separate positions to form a substantial W shape.

18. The lamp system of claim 10, the socket assembly having a pair of socket terminals therein, wherein the first and second internal side walls are in electrical communication with the pair of socket terminals.

* * * * *